US009293085B2

(12) United States Patent
Ikeda

(10) Patent No.: US 9,293,085 B2
(45) Date of Patent: Mar. 22, 2016

(54) PIXEL CIRCUIT WHICH CORRECTS VARIATIONS IN THRESHOLD VOLTAGE FOR A DRIVING TRANSISTOR AND DRIVING METHOD THEREOF

(71) Applicant: CANON KABUSHIKI KAISHA, Tokyo (JP)

(72) Inventor: Kouji Ikeda, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 421 days.

(21) Appl. No.: 13/760,555

(22) Filed: Feb. 6, 2013

(65) Prior Publication Data

US 2013/0222440 A1 Aug. 29, 2013

(30) Foreign Application Priority Data

Feb. 28, 2012 (JP) ..... 2012-040976

(51) Int. Cl.
*G09G 3/32* (2006.01)
*H05B 33/08* (2006.01)

(52) U.S. Cl.
CPC ..... *G09G 3/3258* (2013.01); *G09G 3/3233* (2013.01); *H05B 33/08* (2013.01); *G09G 2300/0861* (2013.01)

(58) Field of Classification Search
CPC ..... G09G 2300/0861; H05B 33/08
USPC ..... 345/76–107, 204–215, 690–699
See application file for complete search history.

(56) References Cited

U.S. PATENT DOCUMENTS 8,243,055 B2 8/2012 Abe ..... 345/211
2006/0043366 A1 3/2006 Ha et al. ..... 257/59
2009/0167648 A1* 7/2009 Jeon ..... G09G 3/3233 345/76
2009/0225009 A1* 9/2009 Ka ..... G09G 3/3233 345/76
2010/0001983 A1 1/2010 Abe ..... 345/211
2010/0265166 A1 10/2010 Kang et al. ..... 345/76
2010/0309187 A1 12/2010 Kang et al. ..... 345/211
2011/0141160 A1* 6/2011 Nathan ..... G09G 3/3233 345/690

(Continued)

FOREIGN PATENT DOCUMENTS

CN 1744180 3/2006
CN 1845230 10/2006

(Continued)

OTHER PUBLICATIONS

Office Action issued on Oct. 10, 2014, in counterpart Chinese patent application 201310063133.9, with translation.

*Primary Examiner* — Ryan A Lubit
(74) *Attorney, Agent, or Firm* — Fitzpatrick, Cella, Harper & Scinto

(57) ABSTRACT

A pixel circuit with a source follower type connection is provided that corrects variation in threshold voltage of a driving transistor, reduces power consumption and realizes high resolution. The pixel circuit includes: a data line for supplying a data voltage; a power source line for supplying a power source voltage; a reference voltage line for supplying a reference voltage lower than the power source voltage; a plurality of control signal lines for supplying control signals; a light emitting element; a driving transistor; a capacitor; and a plurality of switching transistors. The circuit writes the data voltage through one end of the capacitor and subsequently connects the one end of the capacitor to the anode electrode of the light emitting element.

4 Claims, 8 Drawing Sheets

(56) References Cited

U.S. PATENT DOCUMENTS

2011/0199359 A1* 8/2011 Kawabe ..... G09G 3/3233 345/211
2011/0310083 A1* 12/2011 Ikeda ..... G09G 3/20 345/212
2012/0086742 A1* 4/2012 Ikeda ..... G09G 3/3233 345/691
2012/0105501 A1* 5/2012 Nakamura ..... G09G 3/3233 345/690

FOREIGN PATENT DOCUMENTS

| | | |
|---|---|---|
| CN | 101563720 | 10/2009 |
| JP | 2006-251631 | 9/2006 |
| JP | 2008-176287 | 7/2008 |

* cited by examiner

PIXEL CIRCUIT WHICH CORRECTS VARIATIONS IN THRESHOLD VOLTAGE FOR A DRIVING TRANSISTOR AND DRIVING METHOD THEREOF

BACKGROUND OF THE INVENTION

1.Field of the Invention

The present invention relates to a pixel circuit including a light emitting element and a driving method thereof and, in particular, to a pixel circuit applicable to a display apparatus of a self-light-emitting type and a driving method thereof.

2. Description of the Related Art

An display apparatus of the self-light-emitting type, which is typified by an organic electroluminescence (EL) display apparatus, is configured by arranging a plurality of pixels in a matrix on a substrate. In each pixel, a pixel circuit including a light emitting element is arranged. To cause the light emitting element of each pixel to emit light with a luminance based on an image data of each pixel, a current rate flowing into each light emitting element is required to be accurately controlled. Typically, a display apparatus of the self-light-emitting type has an active matrix configuration where an active element (which hereinafter may be called "Tr"), such as a thin film transistor (TFT), is provided on a pixel circuit, to accurately control the current rate flowing in each light emitting element.

Incidentally, TFT formed of polycrystalline silicon (polysilicon, hereinafter called "P-Si") has a higher field effect mobility and a higher ON current than TFT formed of amorphous silicon (hereinafter called "A-Si"). Accordingly, the transistor Tr formed of polysilicon is suitable to the transistor Tr in a pixel circuit used in a high resolution display apparatus. However, the transistor Tr formed of polysilicon has a problem in that variation in electric characteristics tends to occur owing to lattice defect on crystalline grain boundaries. To address the problem, there are techniques described in Japanese Patent Application Laid-Open Nos. 2008-176287 and 2006-251631 that correct variation in threshold of the transistor Tr (variation in threshold voltage) in a pixel circuit with a source follower type connection where the cathode electrode of a light emitting element is connected to a constant voltage and the anode electrode is connected to the source electrode of a driving transistor.

Japanese Patent Application Laid-Open No. 2008-176287 adopts one of a method of driving by changing the potential of a power source line connected to a pixel circuit and a method of driving without changing the potential of a power source line, in the case where a pixel circuit corrects variation in threshold adopting NMOS as a driving the transistor Tr.

However, in the case of driving by changing the potential of the power source line, the power source line typically has a wide wiring width to reduce the resistance and thus has a high parasitic capacitance. Accordingly, there is a problem in that change in potential of the power source line increases power consumption. At the same time, a switch for changing the potential of the power source line is arranged, which causes a problem in that it is difficult to achieve high resolution. Meanwhile, in the case of driving without changing the potential of the power source line, a voltage higher than the potential of the power source line is applied as a pre-charge voltage to the pixel circuit to thereby perform driving. Accordingly, there is a problem in that the required voltage range is increased and thus power consumption is increased.

Japanese Patent Application Laid-Open No. 2006-251631adopts a method of driving without changing the power source line, includes two capacitors in a pixel circuit for correcting variation in threshold, and writes a data voltage using a capacitance ratio. However, requirement of the plurality of capacitors in the pixel circuit causes a problem in that it is difficult to achieve high resolution.

SUMMARY OF THE INVENTION

The present invention thus has an object to provide a pixel circuit with a source follower type connection that corrects variation in threshold voltage of a driving transistor, reduces power consumption and realizes high resolution. The present invention has another object to provide a driving method of a pixel circuit that corrects variation in threshold voltage of a driving transistor while reducing power consumption.

According to an aspect of the present invention, a pixel circuit comprises: a data line for supplying a data voltage; a power source line for supplying a power source voltage; a reference voltage line for supplying a reference voltage lower than the power source voltage; a plurality of control signal lines for supplying control signals; a light emitting element having a cathode electrode connected to a constant potential; a driving transistor having a source electrode connected to an anode electrode of the light emitting element; a capacitor of which one end is connected to a gate electrode of the driving transistor; a first switching transistor for connecting the other end of the capacitor to the data line; a second switching transistor for connecting the other end of the capacitor to the source electrode of the driving transistor; a third switching transistor for connecting the source electrode of the driving transistor to the reference voltage line; a fourth switching transistor for connecting the one end of the capacitor to a drain electrode of the driving transistor; and a fifth switching transistor for connecting the drain electrode of the driving transistor to the power source line, wherein each of the plurality of control signal lines is connected at least to each one of the first to fifth switching transistors, the control signals turn ON or OFF the first to fifth switching transistors, and the same control signal is supplied to gate electrodes of the second and fifth switching transistors.

According to the other aspect of the present invention, a driving method of a pixel circuit comprises: a data line for supplying a data voltage; a power source line for supplying a power source voltage; a reference voltage line for supplying a reference voltage lower than the power source voltage; a light emitting element having a cathode electrode connected to a constant potential; a driving transistor having a source electrode connected to an anode electrode of the light emitting element; a capacitor of which one end is connected to a gate electrode of the driving transistor, wherein the method comprising: a first step of setting the one end of the capacitor at the power source voltage, and setting the other end of the capacitor and the anode of the light emitting element at the reference voltage; a second step of setting, in addition to the setting in the first step, the other end of the capacitor at the data voltage, setting a voltage difference between gate and source electrodes of the driving transistor at a threshold voltage of the driving transistor, and holding, in the capacitor, a voltage difference between the data voltage and a voltage of the gate electrode of the driving transistor; and a third step of setting the drain electrode of the driving transistor at the power source voltage while maintain the voltage difference held in the capacitor in the second step, and setting a voltage difference between the gate electrode of the driving transistor and the anode electrode of the light emitting element at the voltage difference held in the capacitor in the second step, wherein the first, second and third steps are performed in this order.

The present invention allows automatic zero operation of setting the gate-source potential difference of a driving transistor to a threshold voltage of the driving transistor. Accordingly, the variation in threshold voltage of the driving transistor can be corrected. Furthermore, the reference voltage is set to a voltage lower than a power source voltage. While the potential of the gate electrode of the driving transistor is maintained, the drain electrode of the driving transistor can be set to the power source voltage, and the other end of a capacitor and the anode electrode of a light emitting element can be set to a data voltage. Accordingly, voltage range in use can be small, which can reduce power consumption and voltage withstanding load to the transistor, thereby increasing reliability. In addition, driving can be performed while maintaining the power source voltage constant. Accordingly, the power consumption can be further reduced. Moreover, there is no need to provide a power source line control switch around the pixel circuit and to provide two or more capacitors in the pixel circuit. Accordingly, high resolution can be realized.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present invention will hereinafter be described using an example where a pixel circuit of the present invention is applied to an organic EL display apparatus. However, the pixel circuit and a driving method thereof of the present invention are not limited thereto. The pixel circuit is applicable to a display apparatus adopting any of light emitting elements other than an organic EL element, such as an inorganic EL element and an LED.

(First Embodiment)

An example of an organic EL display apparatus to which a pixel circuit of the present invention is applied will now be described as a first embodiment.

1. Pixel Circuit Configuration

Figure 1:
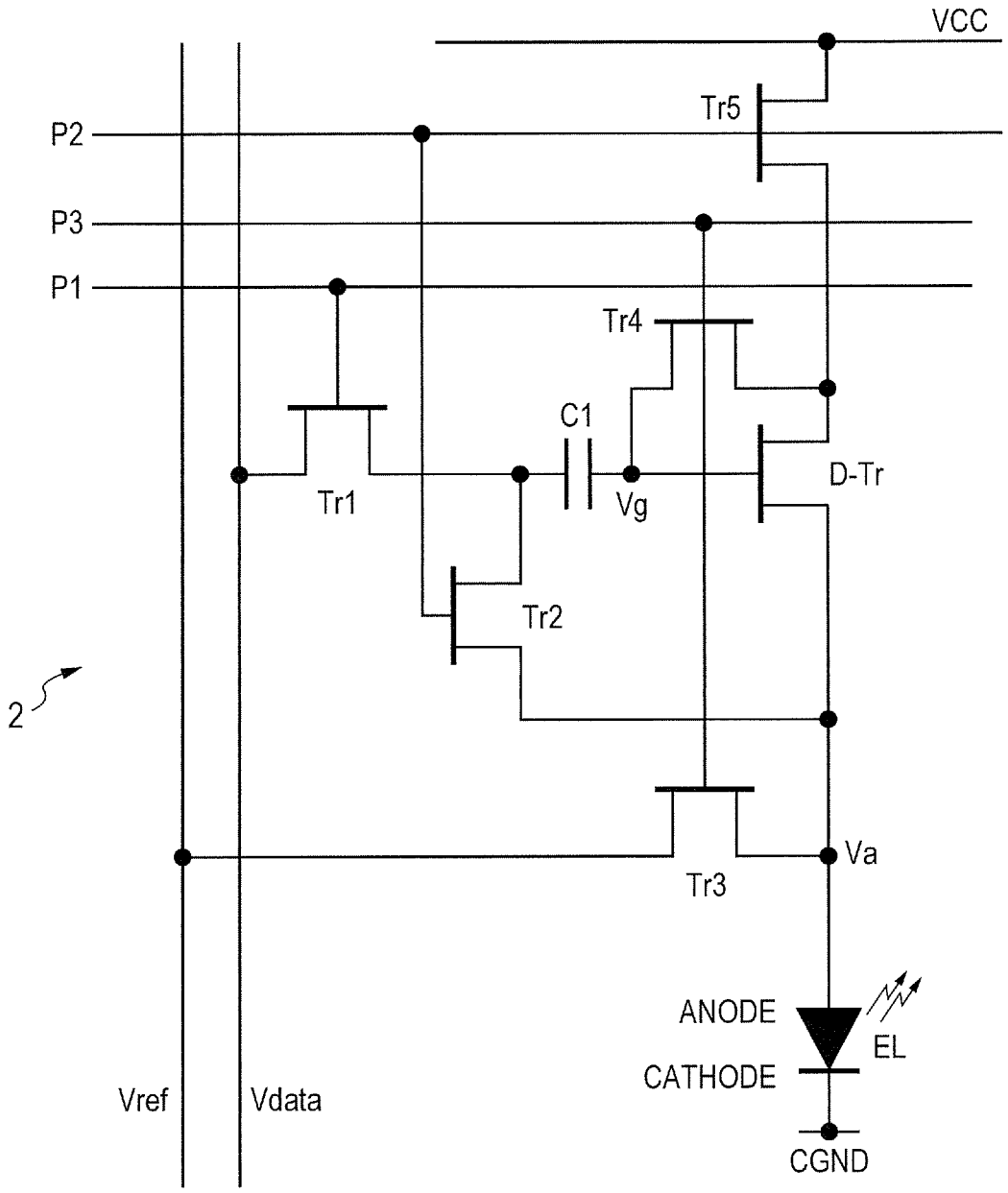
FIG. 1 is a diagram illustrating an example of a pixel circuit of the present invention.

FIG. 1 is an example of a pixel circuit 2. A first switching transistor Tr1 functions as a switch connecting a capacitor C1 to a data line. The transistor Tr1 is an N-channel transistor. The gate electrode is connected to a P1 control signal line. This transistor is conduct during the control signal P1 being at an "H" (HIGH) level, and captures a data voltage Vdata of the data line into the pixel circuit 2. One end of the capacitor C1 is connected to the gate electrode of a driving transistor (D-Tr) controlling a rate of current flowing to a light emitting element. The other end of the capacitor C1 is connected to the transistor Tr1. The anode electrode of the light emitting element is connected to the source electrode of the D-Tr, and the cathode electrode is connected to a constant potential CGND. The D-Tr is a driving circuit supplying a current based on a data voltage Vdata to the light emitting element. The capacitor C1 is a holding circuit holding a voltage. The transistor Tr1 is a data voltage writing circuit that writes a data voltage Vdata into the holding circuit.

A second switching transistor Tr2 functions as a switch connecting the other end of the capacitor C1 to the anode electrode of the light emitting element. The gate electrode is connected to a P2 control signal line. This transistor is conduct during the control signal P2 being at an "H" level.

The transistors Tr1 and Tr2 are an anode potential switching circuit that switches the potential of the anode electrode of the light emitting element to the data voltage Vdata written in the holding circuit.

A third switching transistor Tr3 functions as a switch that connects the anode electrode of the light emitting element to a reference voltage line. The gate electrode is connected to a P3 control signal line. This transistor is conduct during the control signal P3 being at an "H" level, and captures a reference voltage Vref into the anode electrode of the light emitting element.

The transistors Tr2 and Tr3 are a reference voltage setting circuit that sets the holding circuit and the anode electrode of the light emitting element to the reference voltage Vref.

A fourth switching transistor Tr4 functions as a switch that connects the gate electrode of the D-Tr to the drain electrode, and is provided for an after-mentioned automatic zero operation. The gate electrode is connected to the P3 control signal. This transistor is conduct during the control signal P3 being at an "H" level. The transistor Tr4 is a driving voltage reset circuit that resets the driving voltage for the driving circuit (automatic zero).

A fifth switching transistor Tr5 functions as a switch that connects the source electrode of the D-Tr to a power source line. The gate electrode is connected to the P2 control signal line. This transistor is conduct during the control signal P2 being at the "H" level.

The transistors Tr4 and Tr5 are a pre-charge voltage setting circuit that sets the driving circuit to a power source voltage VCC.

In FIG. 1, all the transistors D-Tr and Tr1 to Tr5 are N-channel transistors. However, any of the transistors may be a P-channel transistor pursuant to the design. Note that adoption of a single channel pixel circuit where all the transistors are one of an N-channel transistor and a P-channel transistor can facilitate the manufacturing process.

The light emitting element EL is an organic EL element, and includes two electrodes, which are an anode electrode and a cathode electrode, and an organic EL light emitting layer sandwiched therebetween. In the example in FIG. 1, the anode electrode is connected to the source electrode of the D-Tr, and the cathode electrode is connected to a ground potential CGND.

The power source line is provided with the power source voltage VCC directly from the outside. In a display apparatus where pixels are arranged in a matrix, the power source voltage VCC is supplied to each pixel circuit 2 through power source lines extending in row and column directions.

The reference voltage line is supplied with the reference voltage Vref, which is lower than the power source voltage VCC. For instance, in the case where the reference voltage has the same value as the low level control signal supplied from the control signal line, the control signal line can also used for the reference voltage. In the case where the reference voltage has a value lower than a voltage at which light emitting element emits light, unnecessary current can be prevented from flowing to the light emitting element during an after-mentioned pre-charge period. The reference voltage line may be supplied with the reference voltage Vref directly from the outside as with the power source line or through a column controlling circuit 4 (see FIG. 2).

2. Display Apparatus Configuration

The pixel circuit 2 is connected to the three control signal lines in the row direction and connected to the data line in the column direction. The pixels 1, which include the light emitting element EL and the pixel circuit 2, are arranged in the row and column directions to configure an active matrix display apparatus illustrated in FIG. 2.

Figure 2:
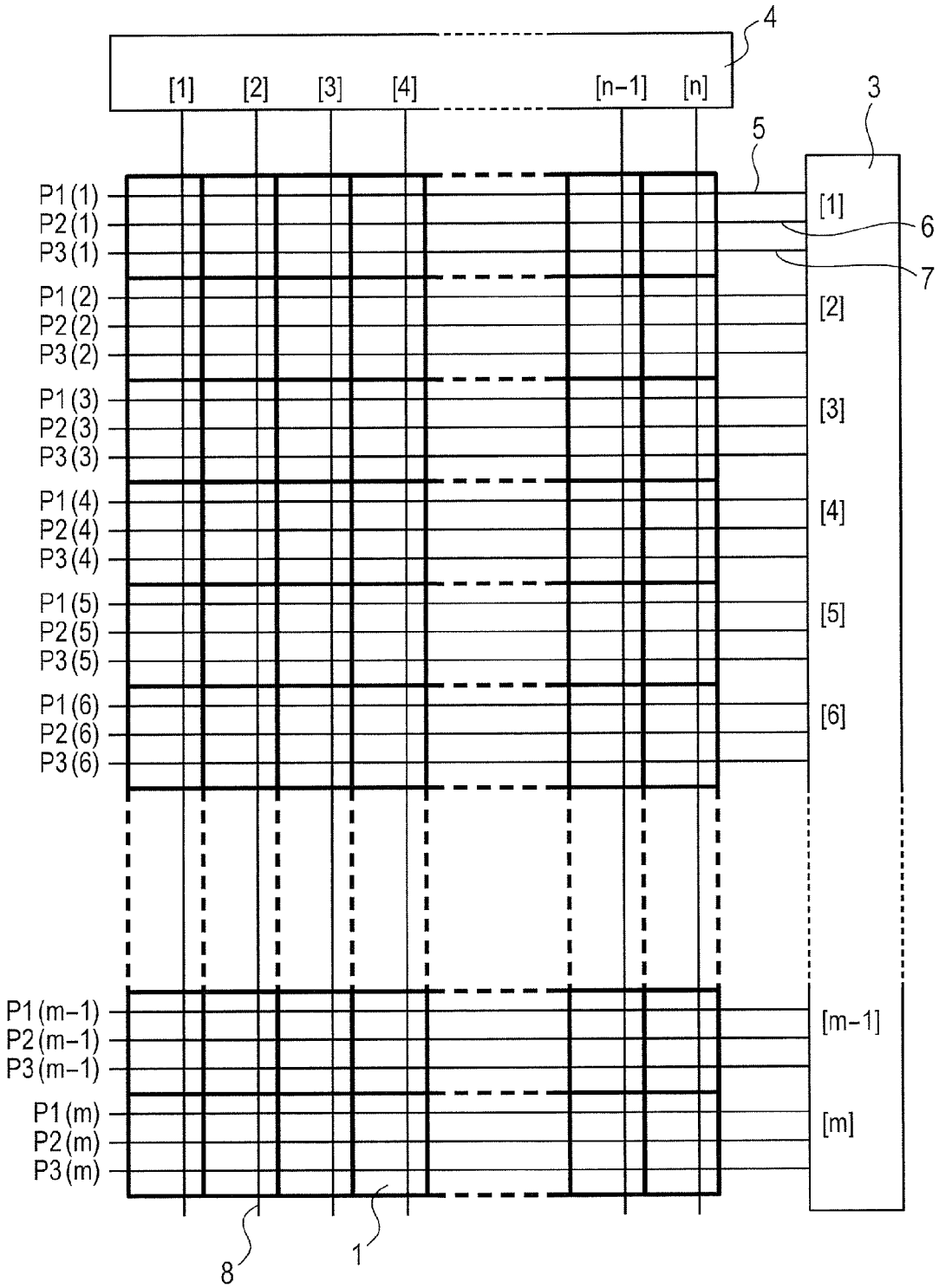
FIG. 2 is an overall diagram of a display apparatus to which the pixel circuit of FIG. 1 is applied.

In the active matrix display apparatus in FIG. 2, the pixels 1 are arranged in a two-dimensional matrix of m rows × n columns. The pixel 1 includes three light emitting elements EL emitting respective three colors of light, which are red (R), green (G) and blue (B), and three pixel circuits 2 supplying current thereto. In FIG. 2, n data lines 8 are illustrated. Each pixel actually includes three data lines, which are R, G and B data lines. Accordingly, the pixels are connected to the total 3n data lines.

Although not illustrated in FIG. 2, the power source lines and the reference voltage lines into which the reference voltage Vref is input are arranged along the rows and columns of the pixel circuit. The row controlling circuit 3 and the column controlling circuit 4 are arranged around the pixel arrangement. Three control lines extend in each row from the row controlling circuit 3. The control signals P1(1) to P1(*m*), P2(1) to P2(*m*), and P3(1) to P3(*m*) on the total m rows are output to the control signal lines.

The control signal P1 is input into the pixel circuit 2 on each row via the P1 control signal line 5. Likewise, the control signal P2 is input into the pixel circuit 2 on each row via the P2 control signal line 6, and the control signal P3 is input thereinto via the P3 control signal line 7.

A video signal is input into the column controlling circuit 4. The data voltage Vdata is output from total 3n output terminals. The data voltage Vdata is a voltage based on a gradation level, and input into the pixel circuit 2 on each column via the data line 8.

3. Circuit Operation

Figure 3:
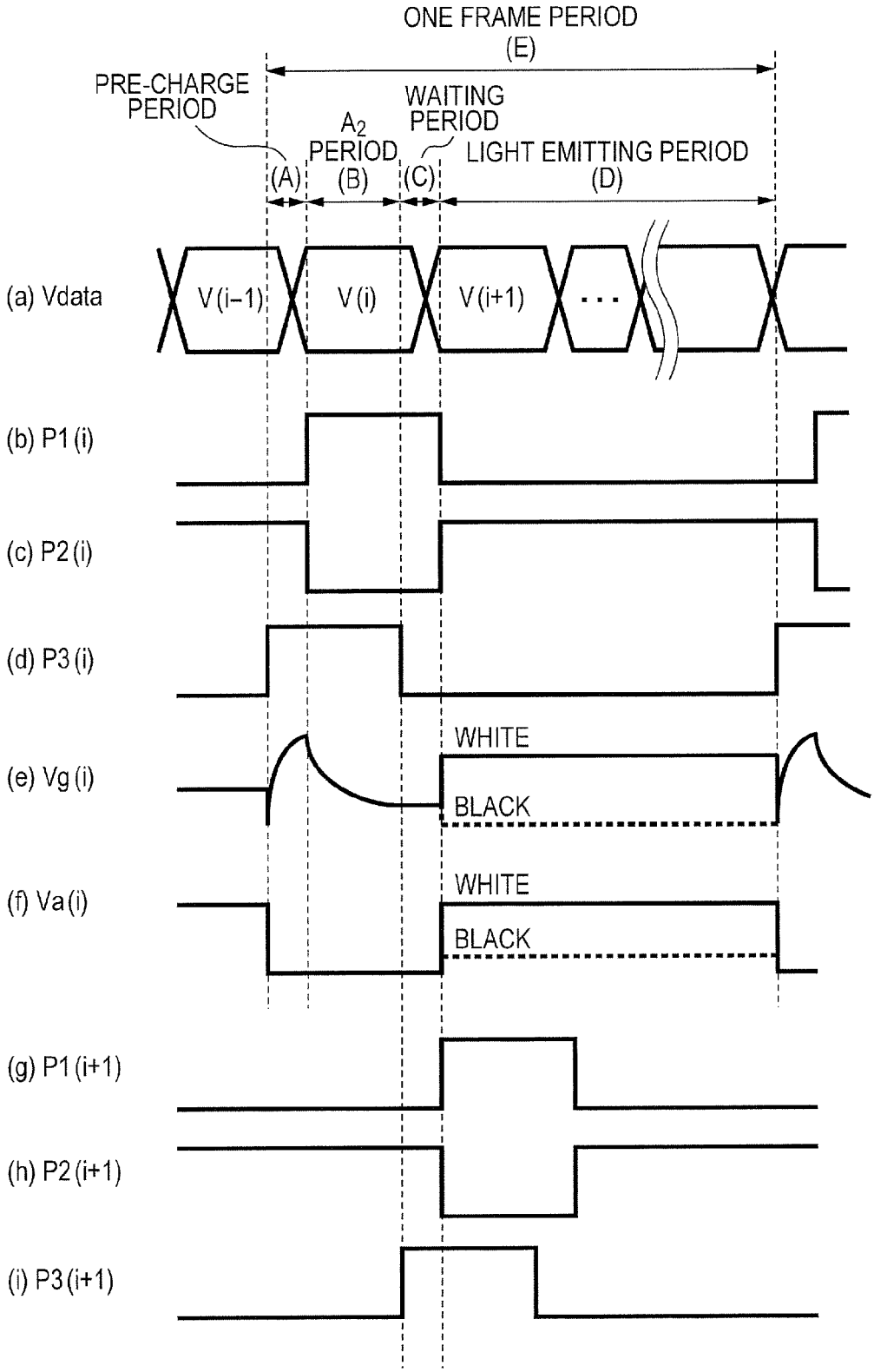
FIG. 3 is a timing chart illustrating an operation of the pixel circuit of FIG. 1.

FIG. 3 is a timing chart illustrates an operation of the pixel circuits 2 of FIG. 1 arranged in a matrix. Each pixel circuit is operated on one row by one row in one frame period. The pixel circuit on a row operated is on the i-th row. (a) to (d) illustrate (a) the data voltage on the data line, (b) the control signal P1(*i*) on the P1 control signal line on the i-th row, (c) the control signal P2(*i*) on the P2 control signal line on the i-th row, and (d) the control signal P3(*i*) on the P3 control signal line on the i-th row. (e) and (f) illustrate (e) the gate voltage Vg(i) of the driving transistor D-Tr on the i-th row, and (f) the source voltage Va(i) of the driving transistor D-Tr on the i-th row. (g) to (i) illustrate (g) the control signal P1(*i*+1) on the P1 control signal line on the (i+1)th-row, (h) the control signal P2(*i*+1) on the P2 control signal line on the (i+1)th-row, and (i) the control signal P3(*i*+1) on the P3 control signal line on the (i+1)th-row.

Provided that a time period during which a certain image data is written into the display apparatus and the next image data is written is one frame period (E), the one frame period can be divided into four periods, which are (A) the pre-charge period, (B) the automatic zero & sampling period, (C) the waiting period, and (D) the light emitting period. The operations in the respective periods (A) to (D) will hereinafter be described.

(A) Pre-Charge Period

In this period, the P1 control signal line is set to "L", the P2 control signal line and the P3 control signal line are set to "H", the transistor Tr1 is turned to OFF, the transistors Tr2 to Try are turned to ON, and the pixel circuit 2 is thus separated from the data line. The gate voltage (Vg) of the D-Tr is set to about VCC. The source voltage (Va) is set to the voltage Vref lower than VCC. At this time, the D-Tr is in an ON state. Setting the voltage Vref to or less than a threshold voltage, at which the light emitting element EL emits light, can prevent unnecessary current from flowing into the light emitting element EL.

(B) Automatic Zero & Sampling Period (Az Period)

Next, while the P3 control signal line remains "H", the P1 control signal line is set to "H" and the P2 control signal line is set to Accordingly, the transistors Tr1, Tr3 and Tr4 are turned ON and the transistors Tr2 and Tr5 are turned OFF. The data voltage V(i) for the row operated (on the i-th row) is applied to the data line from the column controlling circuit 4. The one end of the capacitor C1 that is connected to the transistor Tr1 is set to V(i). At the same time, the drain-source current of the D-Tr discharges the charge of the capacitor C1 through the transistor Tr4. As a result, the gate voltage of the D-Tr drops and the drain-source current of the D-Tr decreases. After a certain time, the gate-source voltage Vgs of the D-Tr converges to the threshold voltage Vth, and the drain-source current becomes about zero. Thus, in the present invention, the current circuit is shared for pre-charge and automatic zero.

As a result, the capacitor C1 holds the voltage difference (Vref+Vth)−V(i) between the data voltage V(i) on the data line and the gate voltage Vref+Vth of the D-Tr. That is, in the automatic zero & sampling period, Vgs of the D-Tr is set to the threshold voltage while the data voltage is written into the end of the capacitor C1 to which the transistor Tr1 is connected.

(C) Waiting Period

Next, the P3 control signal line is set to "L". Accordingly, the transistors Tr3 and Tr4 are turned OFF. The data line is switched to the data voltage Vdata=V(i+1) on the next row. However, the potential difference written in the capacitor C1 is held.

(D) Light Emitting Period

Next, while the P3 control signal line remains "L", the P1 control signal line is set to "L" and the P2 control signal line is set to Accordingly, the transistors Tr1, Tr3 and Tr4 are turned OFF and the transistors Tr2 and Tr5 are turned ON. Turning ON the transistor Tr2 switches connection of the end of the capacitor C1 that is connected to the transistor Tr1 from the data line to the source of the D-Tr, and the potential difference held in the capacitor C1 is set to the gate-source voltage Vgs of the D-Tr. Accordingly, Vgs=V(i)−Vref−Vth. Thus, in the D-Tr, the variation in threshold voltage is corrected, and this transistor is set to allow a current determined by the data voltage V(i) to flow.

At this time, the transistor Tr5 is ON. Accordingly, current is supplied from the power source line to the D-Tr, and a desired current flows into the light emitting element to start light emission.

According to this embodiment, as described above, variation in threshold voltage of the D-Tr is corrected to allow the light emitting element to emit light at a desired luminance. Furthermore, the reference voltage is set to a voltage lower than the power source voltage. While the potential of the gate electrode of the driving transistor is maintained, the drain electrode of the driving transistor can be set to the power source voltage, and the other end of the capacitor and the anode of the light emitting element can be set to the data voltage.

Accordingly, the voltage range in use can be small, the power consumption can be reduced, and the voltage withstanding load to the transistor is allowed to be low, thereby improving reliability. In addition, driving can be performed at a constant power source voltage, and the power consumption can be further reduced. No power source line control switch is required to be provided around the pixel circuit. Two or more capacitors in the pixel circuit are not required. Accordingly, high resolution can be realized. In the case of application to the display apparatus, a narrow frame can be realized. In the case of providing two or more capacitors in the pixel circuit, luminance unevenness due to the capacitance ratio occurs. The present invention provides only one capacitor in the pixel circuit. Accordingly, luminance unevenness does not occur.

(Second Embodiment)

1. Pixel Circuit Configuration

Figure 4:
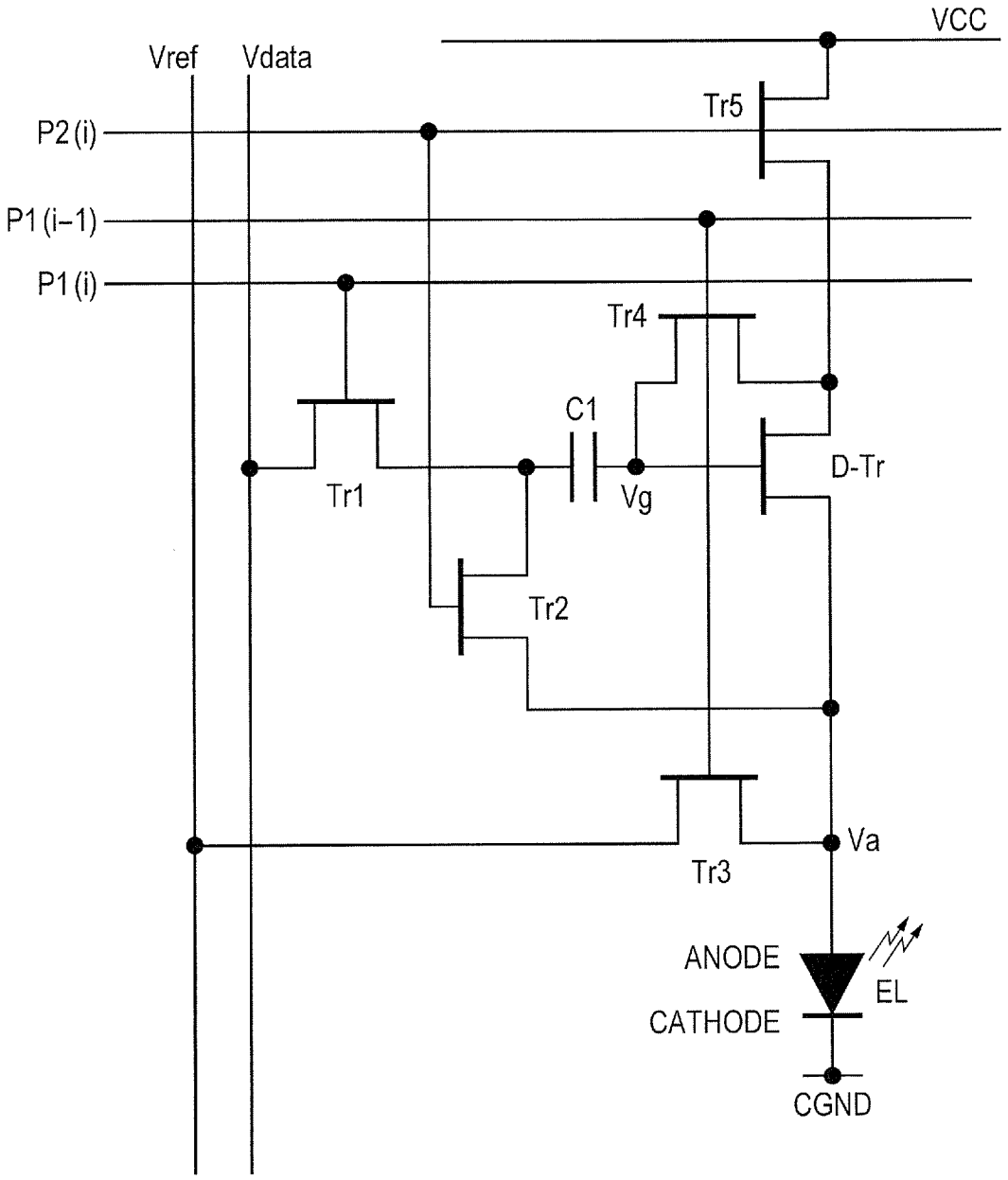
FIG. 4 is a diagram illustrating another example of a pixel circuit of the present invention.

FIG. 4 is a variational example of the pixel circuit of FIG. 1. The connection relationship of the transistors and capacitor elements in the pixel circuit are the same as those in the first embodiment. The transistors Tr3 and Tr4 are not connected to the P3 control signal line on the i-th row but are connected to the P1 control signal line on the (i−1)-th row (row preceding) instead, which is different from that of the first embodiment.

2. Display Apparatus Configuration

Two control signal lines, instead of three, extend from the row controlling circuit 3 on each row, which are different from those of the first embodiment. The control signals P1(1) to P1(*m*), and P2(1) to P2(*m*) on the total m rows are output to the control signal line, and the control signal P1(*i*−1) on the row preceding in addition to the control signal on the row operated is input into the pixel circuit 2, which are different from those of the first embodiment. Other points are the same as those of the first embodiment.

3. Circuit Operation

Figure 5:
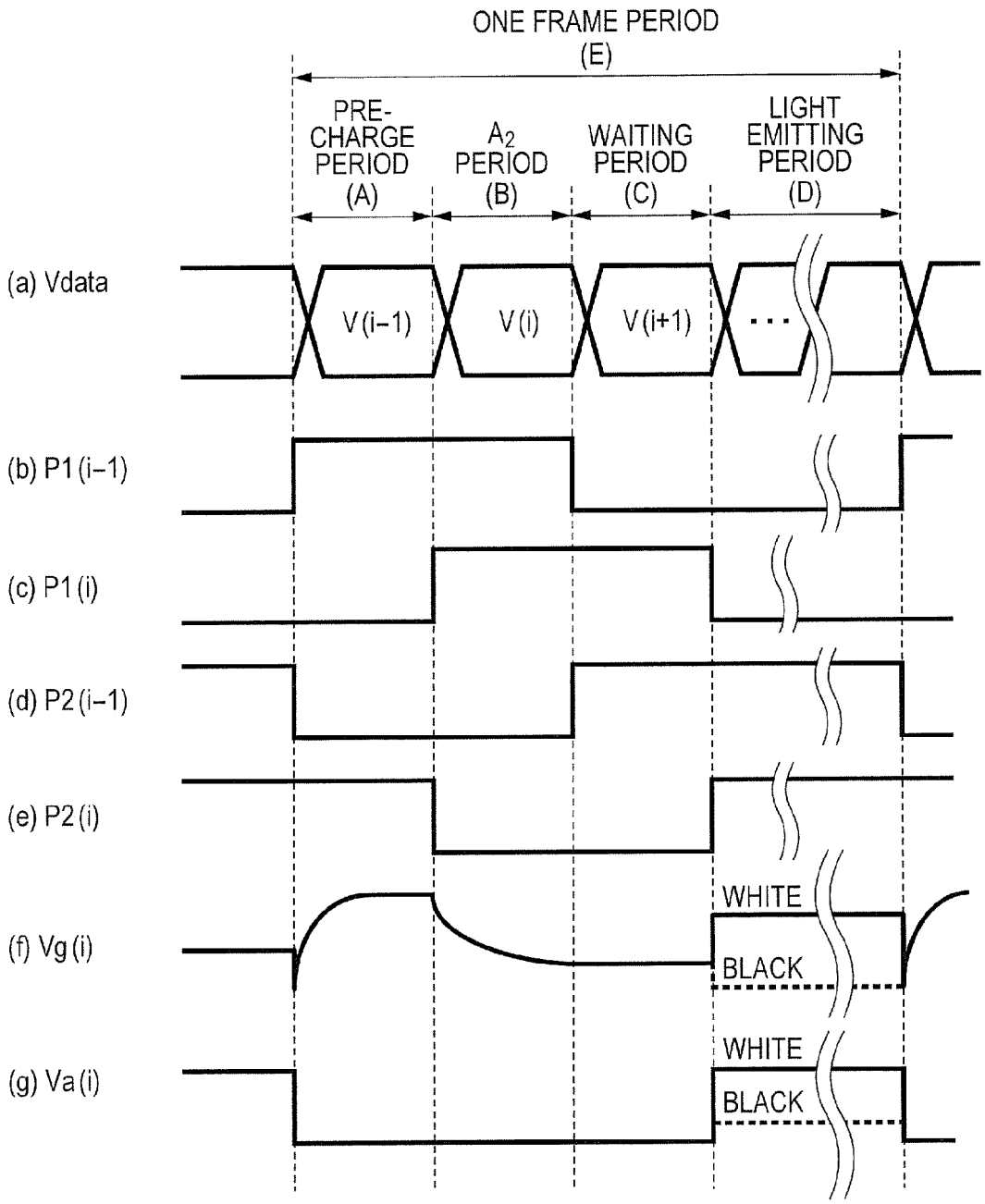
FIG. 5 is a timing chart illustrating an operation of the pixel circuit of FIG. 4.

FIG. 5 is a timing chart illustrating an operation of the pixel circuit 2 of FIG. 4 arranged in a matrix. P1(*i*−1) is used instead of P3(*i*) of the first embodiment. One frame period is divided into four periods, which are (A) the pre-charge period, (B) the automatic zero & sampling period, (C) the waiting period, and (D) the light emitting period, which is the same as that of the first embodiment. However, the length of each period is different from that of the first embodiment. Other points are the same as those of the first embodiment.

This embodiment exerts advantageous effects analogous to those of the first embodiment, and does not require the P3 control signal line. Accordingly, the number of wirings is reduced.

(Third Embodiment)

1. Pixel Circuit Configuration

Figure 6:
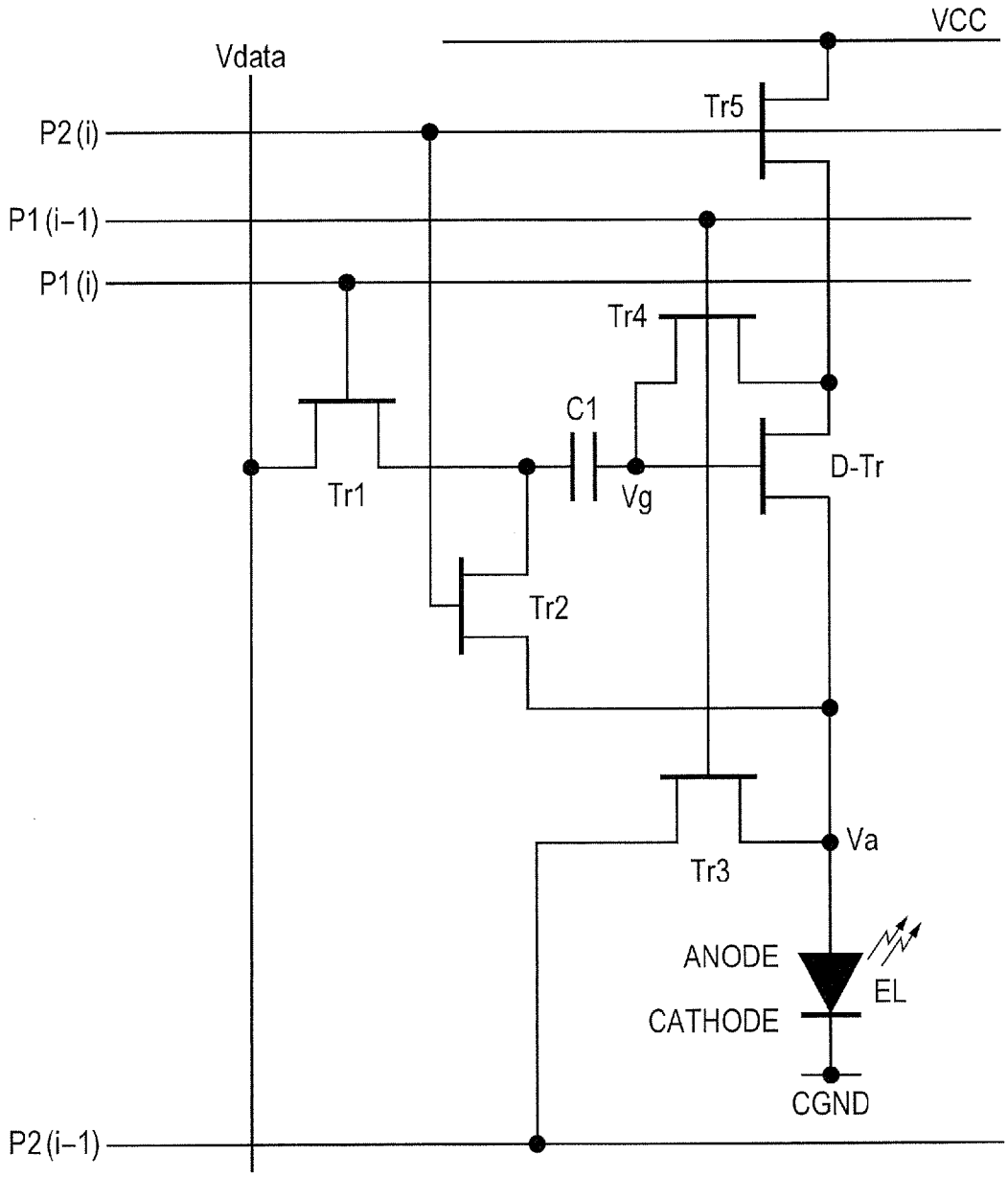
FIGS. 6 and 6A are diagrams illustrating other examples of a pixel circuit of the present invention.
Figure 6A:
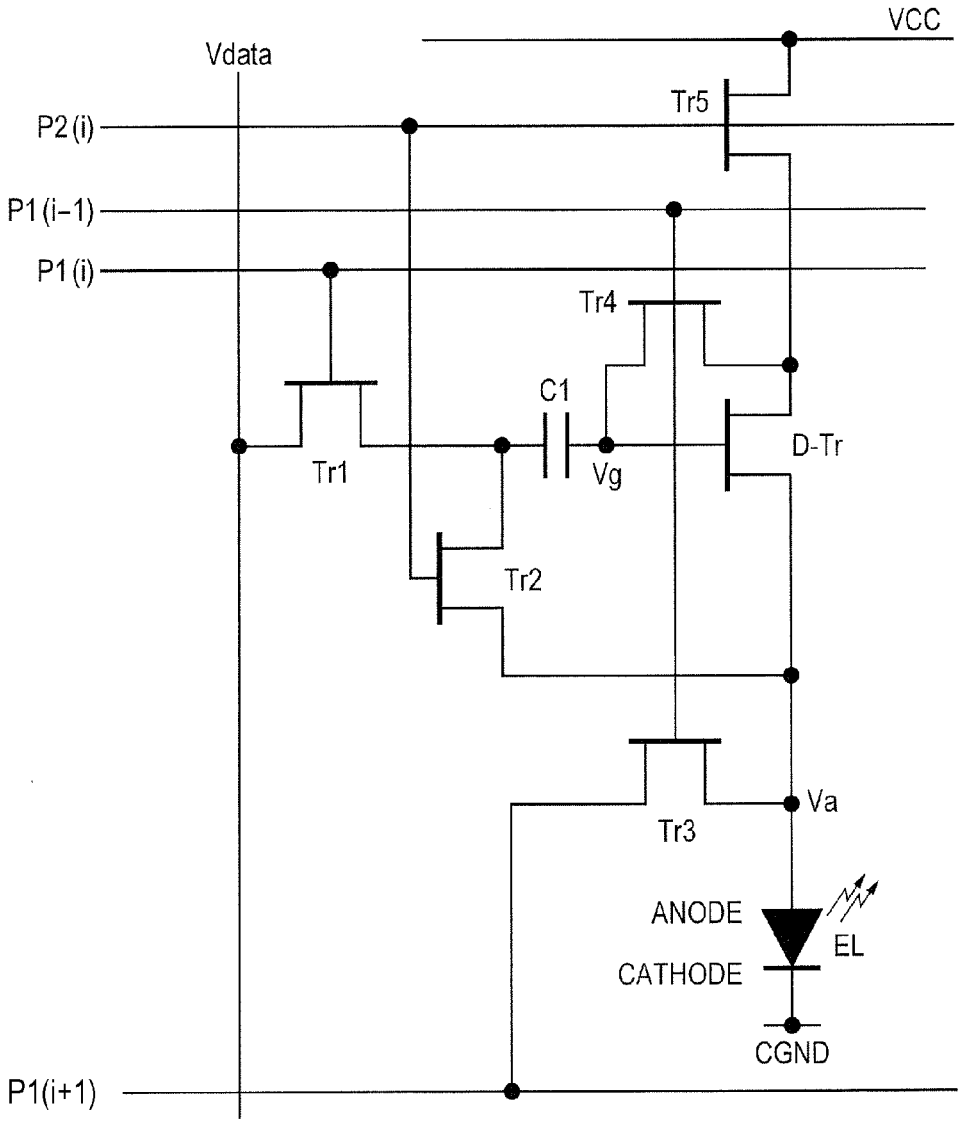

FIG. 6 is a variational example of the pixel circuit of FIG. 4. The connection relationship between the transistors and capacitor elements in the pixel circuit is the same as that of the second embodiment. The one end of the transistor Tr3 is not connected to the reference voltage line but is connected to the P2 control signal line on the (i−1)-th (row preceding), which is different from that of the second embodiment. During time in which the transistor Tr3 is ON, that is, a period in which P1(*i*−1)is "H", connection to the control signal line being at "L" inputs the low level of the control signal line as voltage Vref into the pixel. Accordingly, in addition to FIG. 6, connection to the P1 control signal line on the (i+1)-th row (row following thereto) instead of the P2 control signal line on the (i−1)-th row (row preceding) can also exert the analogous effects, as shown in FIG. 6A.

2 Display apparatus configuration

The control signal P2(*i*−1) on the row preceding in addition to the control signal on the row operated is input into the pixel circuit 2, and the reference voltage line does not separately exist, which are different from those of the second embodiment. More specifically, the control signal P2(*i*−1) on the row preceding also serves as the reference voltage on the row operated. Instead, a configuration may be adopted where the control signal P1(*i*+1) on the row following thereto serves as the reference voltage on the row operated. Other points are the same as those of the second embodiment. In such a configuration, the reference voltage is supplied via the row controlling circuit 3 (see FIG. 2).

3. Circuit Operation

The operation is identical to that of the second embodiment.

This embodiment also exerts the advantageous effects analogous to those of the first embodiment, and does not separately require the P3 control signal line and the reference voltage line. Accordingly, the number of wirings can be further reduced.

(Fourth Embodiment)

Figure 7:
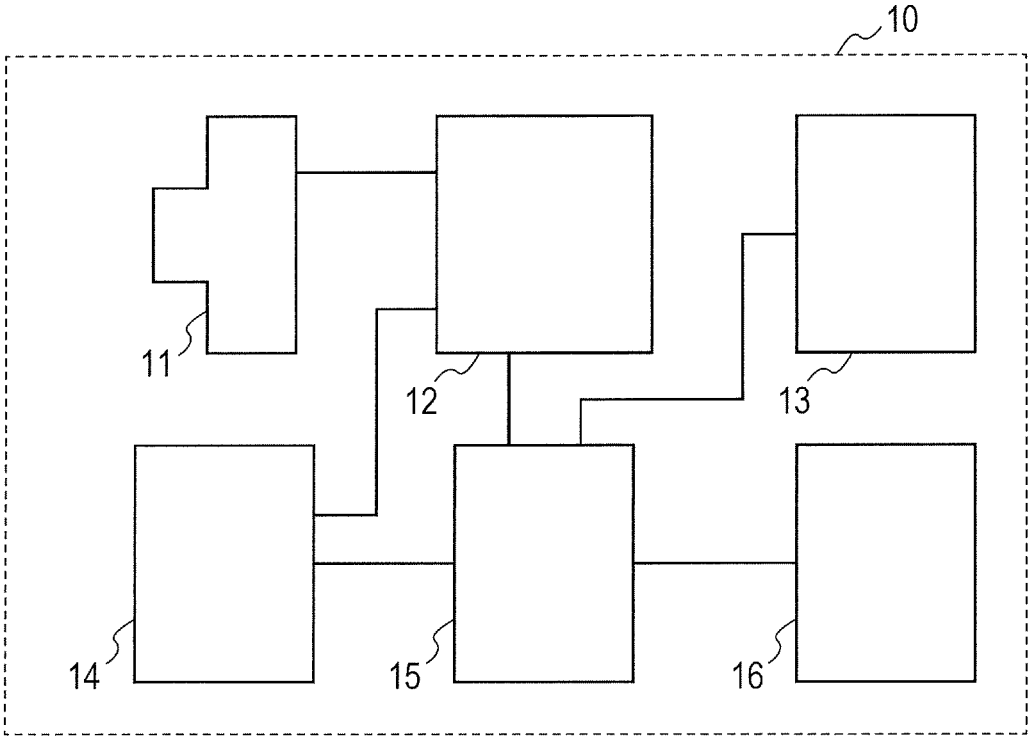
FIG. 7 is a block diagram illustrating an overall configuration of a digital still camera system, which is an exemplary embodiment of the display apparatus to which the pixel circuit of the present invention is applied.

FIG. 7 is a block diagram illustrating an overall configuration of a digital still camera system 10 as an exemplary embodiment of a display apparatus to which the pixel circuit of the present invention is applied. Video taken by the imaging unit 11 or video recorded in the memory 14 are signal-processed by a video signal processing circuit 12, and allowed to be viewed on a display panel 13. The CPU 15 controls the imaging unit 11, the memory 14 and the video signal processing circuit 12 according to input from the operation unit 16, thereby performing imaging, recording, reproduction, and display in conformity with situations.

The pixel circuit and the driving method thereof according to the present invention are applicable to the display apparatus where self-light-emitting type elements are arranged in a matrix. More specifically, the present invention is applicable to an active matrix display apparatus performing display using the self-light-emitting type element, such as EL (electroluminescence) element, driven in a blinking manner and an electric circuit arbitrarily controlling the display period.

For instance, an information display apparatus can be configured using this display apparatus. This information display apparatus adopts, for instance, any of forms of a mobile phone, a mobile computer, a still camera and a video camera. Instead, the apparatus may realize a plurality of the functions thereof. The information display apparatus includes an information input unit. For instance, in the case of a mobile phone, the information input unit includes an antenna. In the case of any of a PDA and a mobile PC, the information input unit includes an interface unit to a network. In the case of any of a still camera and a movie camera, the information input unit includes a sensor unit including any of a CCD and a CMOS.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-040976, filed Feb. 28, 2012, which is hereby incorporated by reference herein in its entirety.

What is claimed is:

1. A pixel circuit comprising:

a data line for supplying a data voltage;

a power source line for supplying a power source voltage;

a reference voltage line for supplying a reference voltage lower than the power source voltage;

a plurality of control signal lines for supplying control signals;

a light emitting element having a cathode electrode connected to a constant potential;

a driving transistor having a source electrode connected to an anode electrode of the light emitting element;

a capacitor of which one end is connected to a gate electrode of the driving transistor;

a first switching transistor for connecting the other end of the capacitor to the data line;

a second switching transistor for connecting the other end of the capacitor to the source electrode of the driving transistor;

a third switching transistor for connecting the source electrode of the driving transistor and the anode electrode of the light emitting element to the reference voltage line;

a fourth switching transistor for connecting the one end of the capacitor to a drain electrode of the driving transistor; and a fifth switching transistor for connecting the drain electrode of the driving transistor to the power source line, wherein each of the plurality of control signal lines is connected at least to each one of the first to fifth switching transistors, the control signals turn ON or OFF the first to fifth switching transistors, and the same control signal is supplied to gate electrodes of the second and fifth switching transistors, wherein the same control signal is supplied to gate electrodes of the third and fourth switching transistors, wherein a plurality of the pixel circuits are arranged in a matrix, and operated one row by one row in one frame period, the third and fourth switching transistors are transistors of the same polarity, and the control signal line connected to gate electrodes of the third and fourth switching transistors of the pixel circuits in a row operated is the same as the control signal line connected to a gate electrode of the first switching transistor of the pixel circuits in a row preceding the row operated, wherein the reference voltage line connected to the source or drain electrode of the third switching transistors of the pixel circuits in the row operated is used also as the control signal line connected to the gate electrode of the second and fifth switching transistors in the row preceding the row operated.

2. A pixel circuit comprising:

a data line for supplying a data voltage;

a power source line for supplying a power source voltage;

a reference voltage line for supplying a reference voltage lower than the power source voltage;

a plurality of control signal lines for supplying control signals;

a light emitting element having a cathode electrode connected to a constant potential;

a driving transistor having a source electrode connected to an anode electrode of the light emitting element;

a capacitor of which one end is connected to a gate electrode of the driving transistor;

a first switching transistor for connecting the other end of the capacitor to the data line;

a second switching transistor for connecting the other end of the capacitor to the source electrode of the driving transistor;

a third switching transistor for connecting the source electrode of the driving transistor and the anode electrode of the light emitting element to the reference voltage line;

a fourth switching transistor for connecting the one end of the capacitor to a drain electrode of the driving transistor; and a fifth switching transistor for connecting the drain electrode of the driving transistor to the power source line, wherein each of the plurality of control signal lines is connected at least to each one of the first to fifth switching transistors, the control signals turn ON or OFF the first to fifth switching transistors, and the same control signal is supplied to gate electrodes of the second and fifth switching transistors, wherein the same control signal is supplied to gate electrodes of the third and fourth switching transistors, wherein a plurality of the pixel circuits are arranged in a matrix, and operated one row by one row in one frame period, the third and fourth switching transistors are transistors of the same polarity, and the control signal line connected to gate electrodes of the third and fourth switching transistors of the pixel circuits in a row operated is the same as the control signal line connected to a gate electrode of the first switching transistor of the pixel circuits in a row preceding the row operated, wherein the reference voltage line connected to the source or drain electrode of the third switching transistors of the pixel circuits in the row operated is used also as the control signal line connected to the gate electrode of the first switching transistor in a row following to the row operated.

3. A driving method of a pixel circuit, wherein the pixel circuit includes: a data line for supplying a data voltage; a power source line for supplying a power source voltage; a reference voltage line for supplying a reference voltage lower than the power source voltage; a light emitting element having a cathode electrode connected to a constant potential; a driving transistor having a source electrode connected to an anode electrode of the light emitting element; and a capacitor of which one end is connected to a gate electrode of the driving transistor, the driving method comprising:

a first step of setting the one end of the capacitor at the power source voltage, and setting the other end of the capacitor and the anode of the light emitting element at the reference voltage;

a second step of setting, in addition to the setting in the first step, the other end of the capacitor at the data voltage, setting a voltage difference between gate and source electrodes of the driving transistor at a threshold voltage of the driving transistor, and holding, in the capacitor, a voltage difference between the data voltage and a voltage of the gate electrode of the driving transistor; and a third step of setting the drain electrode of the driving transistor at the power source voltage while maintain the voltage difference held in the capacitor in the second step, and setting a voltage difference between the gate electrode of the driving transistor and the anode electrode of the light emitting element at the voltage difference held in the capacitor in the second step, wherein the first, second and third steps are performed in this order.

4. The driving method according to claim 3, wherein the pixel circuit further comprises a plurality of control signal lines, and the reference voltage is at the same level as a low level of the control signal supplied to the control line.

* * * * *